United States Patent [19]

Hanazono

[11] 4,343,061

[45] Aug. 10, 1982

[54] BODY WASHING IMPLEMENT FOR BATHING

[76] Inventor: Yōko Hanazono, No. 3-3-7, Ikejiri, Setagaya-ku, Tokyo, Japan

[21] Appl. No.: 94,332

[22] Filed: Nov. 14, 1979

[30] Foreign Application Priority Data

Jan. 17, 1979 [JP] Japan ..... 54-4163[U]
Jun. 7, 1979 [JP] Japan ..... 54-77400[U]
Sep. 10, 1979 [JP] Japan ..... 54-124936[U]

[51] Int. Cl.[3] ..... A47K 7/02

[52] U.S. Cl. ..... 15/244 B; 15/210 R; 128/DIG. 11

[58] Field of Search ..... 15/208, 209 R, 210 R, 15/222, 244 R, 244 B, 244 C; 9/311, 329, 340, 345; 128/DIG. 23, 62 R, 63, 75, 149, 153, 2/60, 68, 179, DIG. 11; 132/55

[56] References Cited

U.S. PATENT DOCUMENTS 2,638,599 5/1953 Flink ..... 128/DIG. 23
3,189,919 6/1965 Chase ..... 128/149
3,696,810 10/1972 Gaylord, Jr. ..... 128/75
4,204,529 5/1980 Cochrane ..... 128/DIG. 23
4,232,663 11/1980 Newton ..... 128/DIG. 23

FOREIGN PATENT DOCUMENTS 504234 7/1954 Canada ..... 15/222
1079672 8/1967 United Kingdom ..... 15/222
1544874 4/1979 United Kingdom ..... 128/DIG. 23

*Primary Examiner*—Edward L. Roberts
*Attorney, Agent, or Firm*—Martin Smolowitz

[57] ABSTRACT

A body washing implement for bathing, comprising an annular sponge member adapted to be deformed to produce two closed loop portions or a generally 8-shaped sponge member having two closed loop portions and a covering cloth of relatively coarsely meshed fabric having the sponge member wrapped therein. The washing implement can be easily knotted in itself or on another washing implement in the form of an elongated strip of cloth such as a towel and facilitates the user of a towel to wash clean a hollow area which tends to be produced in his back when the user of the towel desires to wash his back during bathing.

20 Claims, 17 Drawing Figures

BODY WASHING IMPLEMENT FOR BATHING

FIELD OF THE INVENTION

The present invention relates to bathroom implements and specifically to a body washing implement which is useful particularly when used in combination with a towel or a washcloth for washing such an area of the body of a bath user that is difficult of access by his hands or by the towel or washcloth managed by his hands. The present invention is further concerned with a method of producing such a body washing implement.

BACKGROUND OF THE INVENTION

When one desires to wash his back by the use of a piece of cloth such as a towel in a bathroom, he will scrub his back with the towel by stretching the towel between his hands and moving the thus stretched towel alternately in the opposite directions aslant on his back. In doing so, he grasps one end portion of the towel above one of his shoulders and the other end portion of the towel under the other shoulder, thus raising one of his arms above one shoulder and bending the other of the arms under the other shoulder. Such motions of the arms produce adjacent the blade bone on the side of the raised arm a hollow area which is difficult of access by the towel applied to the back and which cannot be therefore washed sufficiently clean. An easy expedient to obviate such an inconvenience is to make a knot in the middle of a towel and to move the towel in such a manner that the knot in the towel fits in a hollow in the back and scrubs the hollowed area of the back. However, such an expedient causes another inconvenience in that, if the knot produced in the towel is too tight, it is difficult to untie the knot after use of the towel. Various washing implements have therefore been devised which are adapted to facilitate or even tailored to the washing of hollow areas to be produced in the backs of those who wish to wash their backs sufficiently clean during bathing. Typical examples of the prior-art washing implements of this nature are disclosed in Japanese Published Utility Model Applications Nos. 52-95573 and 52-137980 and Japanese Published Utility Models Nos. 48-31743 and 48-32744. Almost every one of the prior-art washing implements disclosed therein consists of a body of sponge having two strings or strips of cloth fastened to the sponge body and extending in opposite directions from the sponge body. A washing implement of this type is as useful as a knotted towel but has problems that the strips or strings thereof are too thin to permit the user of the implement to manage it at his command and that the strips or strings tend to abrade the skin around his shoulders. When, furthermore, the conventional washing implement is used for the washing of any areas other than the back of the user's or another person's body, the strips or strings attached to the sponge body become useless and cumbersome additions.

The present invention contemplates resolution of these problems which have thus far been inherent in known washing implements of the described general nature and aims at provision of an improved washing implement which is useful not only when used indepently of other washing implements such as towels or washcloths but especially when used in combination with a towel or an elongated washcloth for facilitating the user of the towel or washcloth to scrub a hollow area to be produced in his back during bathing.

SUMMARY OF THE INVENTION

In accordance with the present invention, there is provided a body washing implement for bathing, comprising a sponge member having at least one closed loop portion, and a covering web wrapping the sponge member therein. The sponge member may consist exclusively of the above mentioned closed loop portion or may consist of two closed loop portions which merge with each other. The sponge member consisting of the single loop portion may be seamless in its entirety or may be constituted by an elongated blank of sponge having its lengthwise opposite end portions fastened together by suitable fastening means. On the other hand, the sponge member consisting of the two closed loop portions may be constituted by an annular blank of sponge which is twisted substantially in the middle thereof and which has two interlaced portions through which the two closed loop portions merge into each other. One of the closed loop portions may be larger in diameter and/or in cross sectional area than the other. The interlaced portions of the sponge member are fastened together by suitable fastening means. The annular blank of sponge may be seamless in its entirety or may be deformed from an elongated blank of sponge having its lengthwise opposite end portions fastened together by suitable fastening means. As an alternative to the twisted annular sponge member, the sponge member having the two closed loop portions may be constituted by an annular blank of sponge having its diametrically opposed portions fastened together by suitable fastening means. Such an annular blank of sponge may also be either seamless in its entirety or constituted by an originally elongated sponge member having its lengthwise opposite end portions fastened together by suitable fastening means. Each of the fastening means above mentioned may be releasable from the sponge member and may comprise an adhesive, a flexible fastening element such as, for example, a strip or string of cloth or a synthetic resin or a thread of yarn or a synthetic resin, hook-and-eye adhesive tapes, bottons, a combination hook and eye, snap hooks or the like. The covering web having the sponge member wrapped therein is, preferably, comprised of a woven, non-woven, knitted or braided fabric which is relatively coarsely meshed.

While a body washing implement provided by the present invention may be utilized merely as a bath sponge per se, the intrinsic advantage of the implement can be exploited particularly when the washing implement is used in combination with a towel, washcloth or any other known implement in the form of an elongated strip. Thus, the present invention further proposes to provide a combination of a known elongated strip of cloth and a body washing implement having each or any combination of the above described features. If, in this instance, the body washing implement provided by the present invention is of the type which comprises a sponge member having a single closed loop portion, the washing implement is releasably knotted to a lengthwise intermediate portion of the strip of cloth through the opening in the closed loop portion of the sponge member. If, on the other hand, the body washing implement provided by the present invention is of the type which comprises a sponge member having two closed loop portions which merge with each other, the washing implement is releasably knotted to the strip of cloth in such a manner that the two closed loop portions of the sponge member are tied up to each other with one of the loop portions passed through the opening in the other loop portion of the sponge member.

In accordance with the present invention, there is further provided a method of producing a body washing implement for bathing, comprising preparing an elongated sponge member, deforming the sponge member into a generally annular configuration, fastening lengthwise opposite end portions of the sponge member to each other, and wrapping the resultant annular sponge member in covering web of, preferably, a relatively coarsely meshed fabric. A method according to the present invention may further comprise twisting the annular sponge member substantially in the middle thereof so as to produce two interlaced portions in the sponge member, and fastening the interlaced portions together for thereby forming two closed loop portions which merge into each other through the interlaced portions. In accordance with the present invention, a method of producing a body washing implement for bathing may alternatively comprise preparing an annular sponge member, wrapping the sponge member in a covering web of, preferably, a relatively coarsely meshed fabric, twisting the annular sponge member substantially in the middle thereof so as to produce two interlaced portions in the sponge member, and fastening the interlaced portions of the sponge member to each other for thereby forming two closed loop portions which merge with each other through the interlaced portions of the sponge member. The interlaced portions produced in the sponge member in each of the methods above set forth may be releasably fastened together.

DESCRIPTION OF THE DRAWINGS

The features and advantages of the present invention will be appreciated more clearly from the following description taken in conjunction with the accompanying drawings in which.

DETAILED DESCRIPTION OF THE INVENTION

Figure 1:
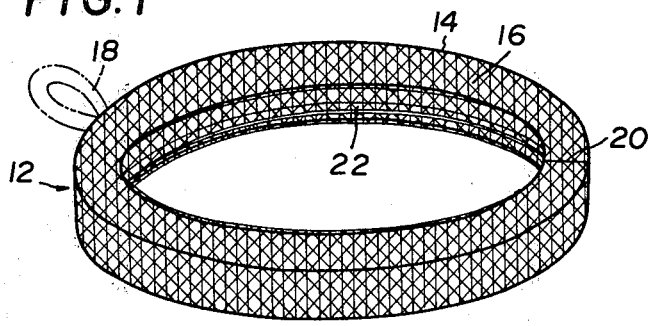
FIG. 1 is a perspective view showing a preferred embodiment of a body washing implement according to the present invention.

Referring to the drawings, first particularly to FIG. 1 thereof, a body washing implement 12 embodying the present invention is shown comprising a generally annular sponge member 14 and a covering web 16 of a relatively coarsely meshed fabric wrapping the sponge member 12 therein. The sponge member 14 is formed of a natural sponge, a foamed plastic or a foamed natural or synthetic rubber, while the covering web 16 is formed of a woven, non-woven, knitted or braided fabric such, as for example, a net comprised of interwoven threads of spun yarn or a non-woven fabric of nylon. The sponge member 14 is shown as having a generally square-shaped cross section throughout its circumferential extent by way of example but may be modified to have an otherwise rectangular cross section or, alternatively, a substantially circular, oval or any regular or irregular polygonal cross section. If desired, the body washing implement 12 may further comprise a looped cord or string 18 for hanging the washing implement on, for example, a wall of a bathroom.

Figure 2:
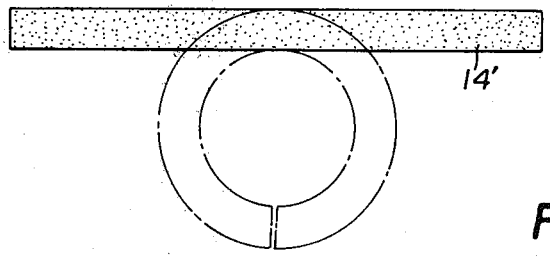
FIG. 2 is a schematic plan view showing a blank of the sponge member to form part of the body washing implement of FIG. 1 in a preferred example of a method according to the present invention.

In the embodiment illustrated in FIG. 1, the annular sponge member 14 is assumed to have a radial seam indicated at 20 and the covering web 16 is assumed to have a circumferential seam 22 along the inner peripheral surface of the sponge member 14. The annular sponge member 14 forming part of the body washing implement 12 shown in FIG. 1 can thus be produced from a straight, elongated blank of sponge as indicated at 14' in FIG. 2. The elongated blank 14' of sponge is deformed into an annular configuration as indicated by dot-and-dash lines in FIG. 2 and is thereafter rendered into the annular sponge member 14 by having its lengthwise opposite end portions bonded together by thermal fusion or with a suitable adhesive or stitched, bound or otherwise tied up together by the use of, for example, a strip or string of cloth or a synthetic resin or a thread of yarn or a synthetic resin, hook-and-eye adhesive tapes, buttons, a combination hook and eye, or snap hooks, though not shown in the drawings.

As an alternative to the annular sponge member 14 thus produced from the straight, elongated blank 14' of sponge, a seamless annular sponge member may be produced by shearing out a circular wad from a sheet of sponge and thereafter punching out the circular wad or by cutting into slices a hollow, cylindrical body of sponge for producing a number of annular sponge members, as will be readily understood.

Figure 3:
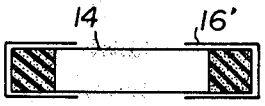
FIG. 3 is a cross sectional view showing the combination of the annular sponge member resulting from the blank shown in FIG. 2 and a covering web to be attached to the annular sponge member to produce the body washing implement illustrated in FIG. 1.

On the other hand, the covering web 16 of the body washing implement 12 illustrated in FIG. 1 may be initially in the form of an elongated strip of fabric. The elongated strip of fabric, schematically indicated at 16' in FIG. 3, is applied to the annular sponge member 14 in such a manner as to cover the outer peripheral surface and the opposite end faces of the sponge member 14 and to have longitudinal end portions extending along the inner peripheral surface of the sponge member 14 as shown in FIG. 3. The longitudinal end portions of the elongated strip 16' are then fastened together on the inner peripheral surface of the annular sponge member by, for example, stitching the portions to each other with a thread or a string so that the annular sponge member 14 is totally wrapped in the elongated strip 16'. The longitudinally opposite end portions of the elongated strip 16' thus arrached to the annular sponge 14 may be either chemically or fusion bonded or otherwise secured to the sponge member 14 or fastened together by, for example, stitching the end portions to each other by means of a thread or a string.

Figure 4:
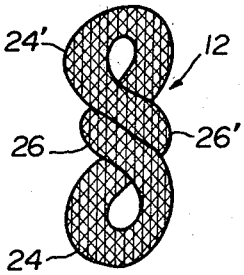
FIG. 4 is a perspective view showing a transitive configuration into which the body washing implement illustrated in FIG. 1 is to be deformed in the process of knotting the body washing implement into the form of a bath sponge.
Figure 5:
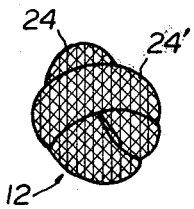
FIG. 5 is a perspective view showing a knot thus obtained when the body washing implement of FIG. 1 is deformed through the configuration illustrated in FIG. 4.

The annular sponge member 14 of the body washing implement 12 has, in itself, a single closed loop portion and can be deformed together with the covering web 16 into a configuration having two closed loop portions. For this purpose, the generally annular body washing implement 12 is first twisted by hands into the form of the figure 8 so as to produce a pair of closed loop portions 24 and 24' which merge with each other through a pair of interlaced portions 26 and 26' as shown in FIG. 4. The implement 12 thus twisted is thereafter further deformed by hands into a knot by forcing one of the two closed loop portions such as the closed loop portion 24 into the opening in the other closed loop portion 24' as shown in FIG. 5.

Figure 6:
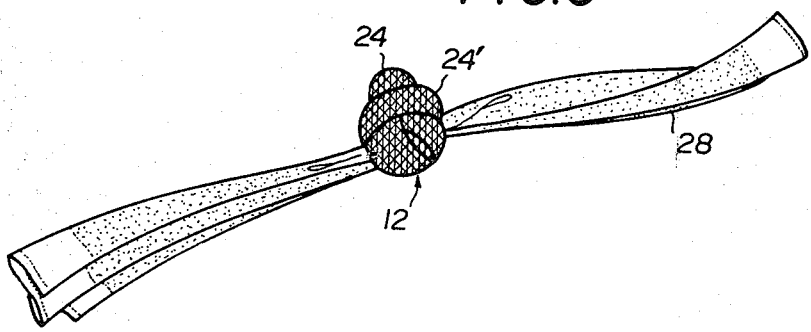
FIG. 6 is a perspective view showing a combination of the body washing implement of FIG. 1 and an elongated washing towel to which the body washing implement is secured in the form of the knot illustrated in FIG. 5.

The washing implement 12 deformed into the knot can be advantageously used as a bath sponge independently of any other washing implement but is more advantageous when used in combination with an elongated strip of cloth such as a washing towel 28 as illustrated in FIG. 6. In FIG. 6, the washing implement 12 is shown knotted on a lengthwise intermediate portion of the washing towel 28 in such a manner that one closed loop portion 24 of the washing implement 12 is forcibly passed through the opening in the other closed loop portion 24' with the intermediate portion of the towel 28 seized by the interlaced portions 26 and 26' (FIG. 4) of the washing implement 12. The body washing implement 12 thus knotted on the towel 28 is useful particularly for scrubbing a hollow area to be produced in the back of a person who desires to wash his back by the use of the towel in a bathroom. After use of the towel or if it is desired to use the towel 28 for purposes other than the washing of the back, the body washing implement 12 can be easily separated from the towel 28 by releasing the loop portions 24 and 24' of the implement 12 from each other. If, furthermore, the body washing implement 12 is sized so that the washing implement fits on the head of human body, the implement can be utilized as a headband or a bath turban for preventing the user of a bath from getting the person's hair wet during bathing or washing his or her face.

Figure 7:
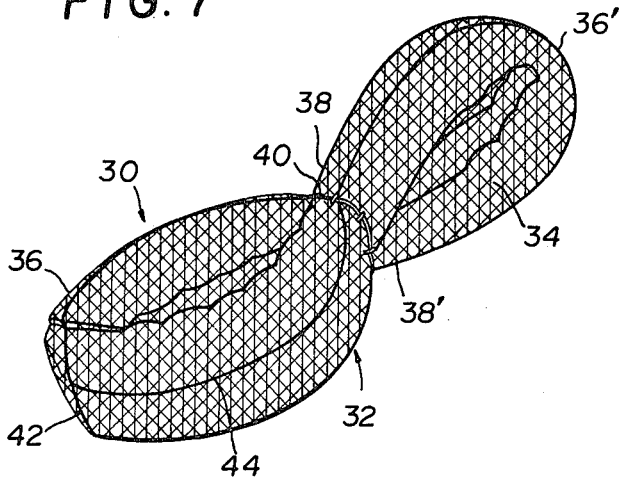
FIG. 7 is a perspective view showing another preferred embodiment of a body washing implement according to the present invention.

FIG. 7 shows another preferred embodiment of a body washing implement according to the present invention. The body washing implement, now designated in its entirety by reference numeral 30, comprises a sponge member 32 and a covering web 34 of a relatively coarsely meshed fabric having the sponge member 32 wrapped therein. The sponge member 32 has, in its entirety, the shape of the figure 8 and consists of two closed loop portions 36 and 36' which merge with each other through two interlaced portions 38 and 38' as shown. As in the embodiment illustrated in FIG. 1, the sponge member 32 of the body washing implement 30 is formed of a natural sponge, a foamed plastic, or a foamed natural or synthetic rubber and the covering web 34 is formed of a woven, non-woven, knitted or braided fabric. Although, furthermore, the sponge member 32 is shown as having a square-shaped cross section, it is apparent that the sponge member 32 may be modified to have an otherwise rectangular cross section or, alternatively, a substantially circular, oval or any regularly or irregularly polygonal cross section if desired.

The interlaced portions 38 and 38' of the sponge member 32 are tied up or bound together by means of a thread 40 of, for example, spun yarn or a synthetic resin. If desired, the thread 40 may be substituted by, for example, a strip or string of cloth or a synthetic resin, hook-and eye adhesive tapes, buttons, a combination hook and eye or snap hooks, though not shown in the drawings. Alternatively, the interlaced portions 38 and 38' of the sponge member 32 may be fusion bonded to each other or may be chemically bonded together by means of a suitable adhesive.

In the body washing implement illustrated in FIG. 7, the generally 8-shaped sponge member 32 is assumed to have a seam 42 formed radially of one of the closed loop portions such as the closed loop portion 36 as shown while the covering web 34 is assumed to have a seam 44 extending throughout the longitudinal extent of the web 34. Thus, the generally 8-shaped sponge member 32 forming part of the body washing implement 30 shown in FIG. 7 can be produced from a straight, elongated blank of sponge as indicated by 32' in FIG. 8. The elongated blank 32' of sponge is wrapped in the covering web 34 having the seam 44 extending longitudinally of the web 34. Though not shown in the drawings, the covering web 34 is initially prepared in the form of an elongated strip of fabric. The elongated strip of fabric is applied to the four longitudinal faces of the blank 32' of sponge in such a manner as to have its longitudinal end portions located adjacent to each other on one of the four longitudinal faces of the blank 32'. The longitudinal end portions of the elongated strip of fabric are thereafter fastened together on the particular face of the blank 32' of sponge by, for example, stitching the portions to each other with a thread or string so that the elongated blank 32' of sponge is wrapped in the elongated strip of fabric throughout the length of the blank. The longitudinally opposite end portions of the elongated strip of fabric thus applied to the elongated blank 32′ of sponge may be either chemically or fusion bonded or otherwise secured to the opposite end faces of the blank or seamed, tied up or bonded in themselves in a suitable manner.

Figure 9:
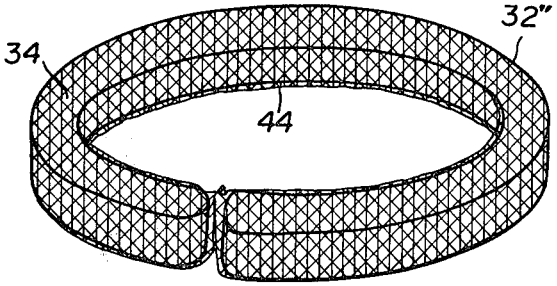
FIG. 9 is a perspective view showing a transitive configuration which the combination of the blanks of the sponge member and covering web illustrated in FIG. 8 assumes in the process of deforming the combination of the blanks of the sponge member and covering web of FIG. 8 into the form of the body washing implement illustrated in FIG. 7.

The elongated blank 32′ of sponge thus wrapped in the covering web 34 is deformed into an annular blank 32″ as illustrated in FIG. 9. The longitudinally opposite end portions of the annular blank 32″ are fastened together across the opposite end portions of the covering web 34. For this purpose, the opposite end portions of the blank 32′ of sponge may be bonded together by fusion or with a suitable adhesive or may be stitched, bound or otherwise tied up to each other by the use of, for example, a strip or string of cloth or a synthetic resin or a thread or yarn or a synthetic resin, hook-and-eye adhesive tapes, buttons, a combination hook and eye, or snaps. Alternatively, the end portions of the annular blank 32″ of sponge may be held together by fastening together the opposite end portions of the covering web 34 by any of the above mentioned fastening means.

Figure 8:
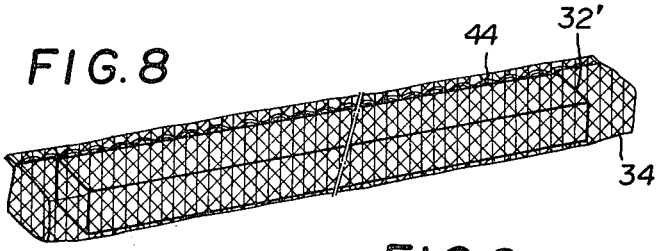
FIG. 8 is a fragmentary perspective view showing a combination of blanks of the sponge member and the covering web to form part of the body washing implement of FIG. 7 in another preferred example of a method according to the present invention.

The annular blank 32″ of sponge thus prepared and wrapped in the covering web 34 is then twisted substantially in the middle thereof so as to be deformed into the form of the figure 8, thereby producing the two closed loop portions 36 and 36′ which merge into each other through the interlaced portions 38 and 38′ as shown in FIG. 7. The body washing implement 30 is completed when the tying thread 40 or any alternative thereof is applied to the blank 32″ thus twisted into the form of the figure 8. It is apparent that a sponge member having two closed loop portions which merge with each other can be also obtained from an annular blank of sponge by simply fastening together diametrically opposed portions of the blank.

As an alternative to the annular blank 32″ of sponge deformed from the straight, elongated blank 32′ of sponge, a seamless annular sponge produced from, for example, a sheet of sponge or a hollow, cylindrical body of sponge as previously discussed by used to construct a body washing implement similar to the embodiment of FIG. 7. Furthermore, a sponge member having two closed loop portions may be punched out from a sheet of sponge or may be produced by cutting into slices a unitary body of sponge having a generally 8-shaped cross section and thus formed with two bores to form the openings respectively in the two closed loop portions in the resultant sponge member. Such an originally 8-shaped sponge member or a sponge member obtained by fastening together diametrically opposed portions of an annular blank of sponge as above described is inferior in respect of the resistance to compressive or bending load to a sponge member obtained by twisting an annular blank of sponge. An originally 8-shaped sponge member in particular is, however, advantageous in that no fastening means is necessitated to maintain the 8-shaped configuration of the sponge member.

Figure 10:
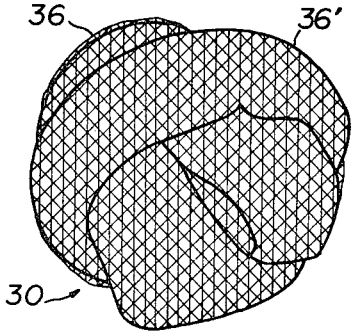
FIG. 10 is a perspective view showing a knot which is obtained when the body washing implement illustrated in FIG. 7 is deformed or knotted into the form of a bath sponge.

In order that the body washing implement 30 shown in FIG. 7 be used as a bath sponge independently of any other washing implement such as a towel, one of the two closed loop portions such as for example the closed loop portion 36 of the sponge member 32 is stuffed into the opening in the other closed loop portion 36′ so that the body washing implement 30 forms a knot as shown in FIG. 10. If, on the other hand, it is desired to use the body washing implement 30 as an ancillary to a towel or any other elongated strip of cloth, the washing implement 30 is knotted on a lengthwise intermediate portion of the towel or the elongated strip of cloth in such a manner that one closed loop portion of the washing implement is stuffed into the other closed loop portion of the implement with the intermediate portion of the towel or the strip of cloth seized by the two interlaced portions of the washing implement as previously described with reference to FIG. 6. If, in this instance, the closed loop portion to receive the other closed loop portion is sized to be smaller than the latter, the latter can be closely stuffed into the former so that a tighter knot will be produced by the loop portions.

Figure 12A:
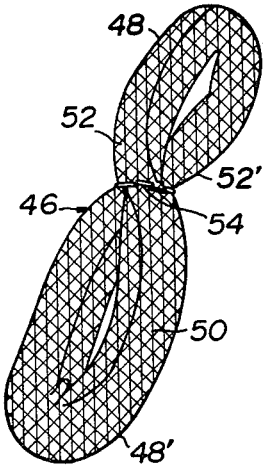
FIGS. 12A, 12B and 12C are perspective views each showing an embodiment of a body washing implement using the sponge member initially having the configuration illustrated in FIG. 11.
Figure 12B:
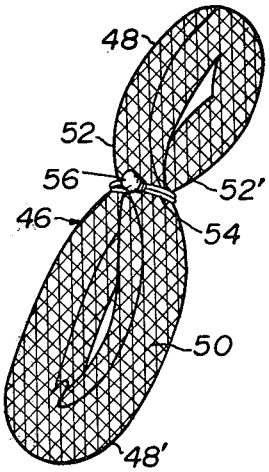
Figure 12C:
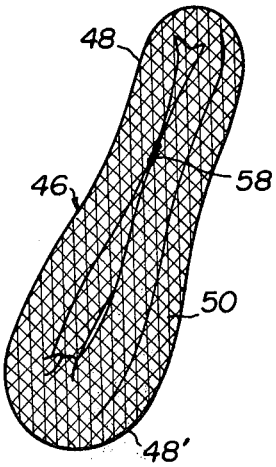
Figure 11:
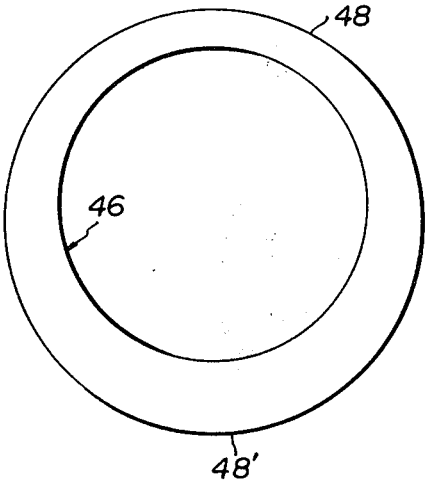
FIG. 11 is a schematic plan view showing the configuration of a sponge member which to be deformed to form part of still another preferred embodiment of a body washing implement according to the present invention.

FIG. 11 shows the configuration of a sponge member 46 which is adapted to be deformed to form part of still another embodiment of a body washing implement according to the present invention. As shown, the sponge member 46 has a generally annular configuration and consists of arcuate or semicircular smaller-section and larger-section portions 48 and 48′ which merge continuously with each other. The smaller-section and larger-section portions 48 and 48′ of the sponge member 46 have cross sectional areas which are respectively smaller and larger than each other and which vary continuously into each other. The sponge member 46 thus initially configured is wrapped in a covering web 50 of a relatively coarsely meshed fabric and is deformed into the shape of the figure 8 as shown in each of FIGS. 12A, 12B and 12C. In each of the body washing implements illustrated in FIGS. 12A, 12B and 12C, the sponge member 46 deformed into the shape of the figure 8 has two closed loop portions which are constituted by the smaller-section and larger-section portions 48 and 48′ of the sponge member 46 initially configured. In each of the embodiments illustrated in FIGS. 12A and 12B, furthermore, the smaller-section and larger-section closed loop portions 48 and 48′ of the sponge member 46 merge with each other through two interlaced portions 52 and 52′ which are twisted on each other and which are tied up or bound together by suitable fastening means. The fastening means may comprise a thread 54 of, for example, spun yarn or a synthetic resin stitched to the interlaced portions 52 and 52′ of the sponge member 46 as in the embodiment illustrated in FIG. 12A or detachably tied to the interlaced portions 52 and 52′ of the sponge member 46 and secured to the sponge member 46 by making a knot 56 as in the embodiment illustrated in FIG. 12B. As an alternative, the sponge member 46 having the initial configuration illustrated in FIG. 11 may be deformed into the shape of the figure 8 simply by bonding together those portions of the sponge member 46 which intervene between the smaller-section and larger-section portions 48 and 48′ of the sponge member 46 as indicated at 58 in FIG. 12C.

Figure 13A:
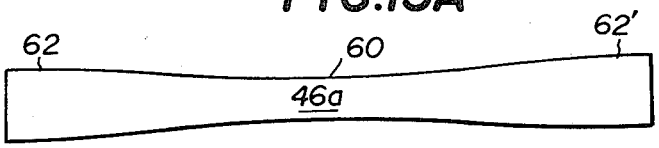
FIGS. 13A and 13B are schematic plan views showing preferred examples of a blank of sponge to form a sponge member having the configuration illustrated in FIG. 11.
Figure 13B:
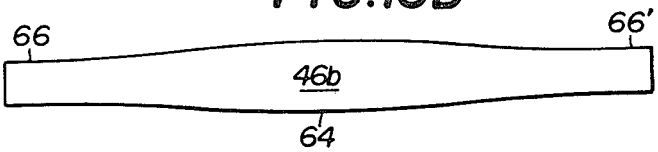

The sponge member 46 having the configuration illustrated in FIG. 11 may be punched out from a flat sheet of sponge (not shown) or may be produced from an elongated, generally bar-shaped blank of sponge as shown in FIG. 13A or FIG. 13B. In FIG. 13A, a bar-shaped blank of sponge, denoted by 46*a*, consists of a relatively slender intermediate portion 60 and enlarged opposite end portions 62 and 62′ which are larger in cross sectional area than the intermediate portion 60. On the other hand, a bar-shaped blank of sponge 46*b* shown in FIG. 13B consists of an enlarged intermediate portion 64 and reduced opposite end portions 66 and 66′ which are smaller in cross sectional area than the intermediate portion 64. Each of the bar-shaped blanks 46*a* and 46*b* thus shaped is deformed into the annular configuration illustrated in FIG. 11 by having the enlarged opposite end portions 62 and 62' of the blank 46*a* or the reduced opposite end portions 66 and 66' of the blank 46*b* bonded or otherwise secured together by suitable fastening means (not shown).

Figure 14:
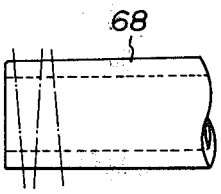
FIG. 14 is a schematic side view showing a portion of a blank of sponge from which a number of sponge members each having the configuration illustrated in FIG. 11 may be produced.

The sponge member 46 having the configuration illustrated in FIG. 11 may also be produced from a tubular blank of sponge 68 shown in FIG. 14. The tubular blank of sponge 68 may have a uniformly thick wall as indicated by broken lines or may consist of thinner and thicker semicylindrical wall portions. The tubular blank 68 having a uniformly thick wall may be sliced into a number of pieces on planes which are inclined alternately in opposite directions with respect to the center axis of the blank as indicated by dot-and-dash lines in FIG. 14. On the other hand, the tubular blank consisting of thinner and thicker semicylindrical portions may be sliced on planes substantially perpendicular to the center axis of the blank, though not shown in the drawings.

What is claimed is:

1. A body washing implement, comprising a sponge member having a covering web wrapping the sponge member therein, said sponge member consisting of two closed loop portions which merge with each other.

2. A body washing implement as set forth in claim 1, in which said sponge member is constituted by an originally annular blank of sponge which is twisted substantially in the middle thereof and which has two interlaced portions through which said two closed loop portions merge into each other.

3. A body washing implement as set forth in claim 2, in which said interlaced portions of the sponge member are fastened together.

4. A body washing implement as set forth in claim 2, in which said annular sponge member is seamless in its entirety.

5. A body washing implement as set forth in claim 2, in which said annular sponge member is constituted by an originally elongated blank of sponge having its lengthwise opposite end portions fastened together.

6. A body washing implement as set forth in any one of claims 3 or 5, wherein: said portions fastened together are fastened together by fastening means which is releasable from the sponge member.

7. A body washing implement as set forth in claim 1, in which said sponge member is constituted by an originally annular blank of sponge having its diametrically opposed portions fastened together.

8. A body washing implement as set forth in claim 7, in which said sponge member has two interlaced portions through which said closed loop portions merge with each other.

9. A body washing implement as set forth in claim 7, in which said annular blank of sponge is constituted by an originally elongated blank of sponge having its lengthwise opposite end portions fastened together.

10. A body washing implement as set forth in any one of claims 1, 2, 3, 4, 5, 7 and 8, in which one of said loop portions is larger in diameter than the other.

11. A body washing implement as set forth in any one of claims 1, 2, 3, 4, 5, 7 and 8, in which one of said loop portions is larger in cross sectional area than the other.

12. A body washing implement as set forth in claim 1, in which said loop portions have cross sectional areas which continuously vary into each other.

13. A method of producing a body washing implement for bathing, comprising preparing an elongated sponge member, deforming the sponge member into a generally annular configuration, fastening lengthwise opposite end portions of the sponge member to each other, and wrapping the resultant annular sponge member in a covering web.

14. A method as set forth in claim 13, further comprising twisting said annular sponge member substantially in the middle thereof so as to produce two interlaced portions in the sponge member, and fastening the interlaced portions together for thereby forming two closed loop portions which merge with each other through said interlaced portions.

15. A method of producing a body washing implement for bathing, comprising preparing an annular sponge member, wrapping the sponge member in a covering web, twisting the annular sponge member substantially in the middle thereof so as to produce two interlaced portions in the sponge member, and fastening said interlaced portions together for thereby forming two closed loop portions which merge with each other through said interlaced portions.

16. A method as set forth in claim 15, in which said interlaced portions of the sponge member are releasably fastened together.

17. A method as set forth in claim 15, in which said annular sponge member is prepared from an elongated blank of sponge.

18. A method as set forth in claim 17, in which said elongated blank of sponge has a lengthwise intermediate portion and opposite end portions which are larger in cross sectional area than said intermediate portion.

19. A method as set forth in claim 17, in which said elongated blank of sponge has a lengthwise intermediate portion and opposite end portions which are smaller in cross sectional area than said intermediate portion.

20. A method as set forth in claim 19, in which said annular sponge member is twisted substantially in the middle thereof in such a manner that one of said closed loop portions of the sponge member is formed by said intermediate portion of said blank and the other of the loop portions is formed by said opposite end portions of the blank.

* * * * *